US011370511B2

(12) United States Patent
Poscente

(10) Patent No.: US 11,370,511 B2
(45) Date of Patent: Jun. 28, 2022

(54) WATER SKI FIN

(71) Applicant: Competition Systems Inc., Calgary (CA)

(72) Inventor: Jay Poscente, Calgary (CA)

(73) Assignee: Competition Systems Inc., Calgary (CA)

( * ) Notice: Subject to any disclaimer, the term of this patent is extended or adjusted under 35 U.S.C. 154(b) by 16 days.

(21) Appl. No.: 17/120,342

(22) Filed: Dec. 14, 2020

(65) Prior Publication Data

US 2022/0144387 A1 May 12, 2022

Related U.S. Application Data

(60) Provisional application No. 63/111,521, filed on Nov. 9, 2020.

(51) Int. Cl.

| | |
|---|---|
| ***B63B 32/60*** | (2020.01) |
| ***B63B 32/30*** | (2020.01) |
| ***B63B 32/66*** | (2020.01) |
| ***B63B 32/50*** | (2020.01) |

(52) U.S. Cl.

CPC ..... *B63B 32/60* (2020.02); *B63B 32/30* (2020.02); *B63B 32/50* (2020.02); *B63B 32/66* (2020.02)

(58) Field of Classification Search

CPC ..... B63B 32/00; B63B 32/30; B63B 32/50; B63B 32/60; B63B 32/62; B63B 32/64; B63B 32/66

See application file for complete search history.

(56) References Cited

U.S. PATENT DOCUMENTS

| | | | | | |
|---|---|---|---|---|---|
| 5,030,151 | A * | 7/1991 | Beacham | B63B 32/66 | 114/127 |
| D680,182 | S * | 4/2013 | Holliday | D21/778 | |
| D680,606 | S * | 4/2013 | McKee | B63B 32/64 | D21/778 |
| D710,778 | S * | 8/2014 | Murphy | B63B 32/60 | D12/199 |
| 9,334,027 | B1 * | 5/2016 | Daniels | B63B 32/64 | |
| 9,511,827 | B2 * | 12/2016 | Lowell | B63B 32/60 | |
| D857,827 | S * | 8/2019 | Dustin | D21/806 | |
| 10,723,417 | B2 * | 7/2020 | Poscente | B63B 32/64 | |
| D927,380 | S * | 8/2021 | Lanza | B63B 32/66 | D12/199 |

FOREIGN PATENT DOCUMENTS

| | | | | |
|---|---|---|---|---|
| GB | 2136739 A * | 9/1984 | B63B 35/7926 | |
| WO | WO-2018138263 A1 * | 8/2018 | B63B 35/7926 | |

* cited by examiner

*Primary Examiner* — Ajay Vasudeva

(74) *Attorney, Agent, or Firm* — Christopher P. Maiorana, PC

(57) ABSTRACT

A water ski fin comprising a planar body and a plurality of chevrons. The planar body may have a top end, a convex leading edge, and a trailing edge. The mounting elements on the top end may mount the fin on a tail of a water ski. A bottom may connect the leading edge to the trailing edge. A plurality of chevrons may have alternating crests and troughs positioned in the trailing edge.

19 Claims, 6 Drawing Sheets

WATER SKI FIN

This application relates to U.S. Provisional Application No. 63/111,521, filed on Nov. 9, 2020, which is hereby incorporated by reference in its entirety.

FIELD OF THE INVENTION

The invention relates to water skiing generally and, more particularly, to a method and/or apparatus for implementing a water ski fin.

BACKGROUND

Water skiing is a popular sport, both as a recreational activity and a competitive sport. Water skis are designed for safety for all levels of water skiers (i.e., to help prevent skiers from falling). Water skis are also designed for performance to provide a competitive advantage. An important safety and performance aspect of the water ski design is the ski fin.

While slalom skiing, the fin is virtually always sliding sideways through the water to some extent. The sideways slide creates a pressure differential between the two sides of the fin. Water on the high-pressure side seeks to curl around the back of the fin into swirling eddies on the lower pressure side of the fin. The eddies on the low-pressure side create unwanted lift and cavitation that reduces the efficiency of the fin and the ability of the fin keep the tail of the ski under water (i.e., a primary function of the water ski fin).

Since the whole ski drifts outward while rounding turns, if the skier yaws more of the tip of the water ski into the water, the tip drifts less than the tail and the radius of the turn gets tighter. However, the ski acts like a teeter-totter (i.e., a lever) with the fulcrum of the lever being near the feet of the skier. The more the skier yaws the tip of the ski into the water, the more the tail gets levered up towards the surface of the water. If the skier yaws the tip of the ski into the water too aggressively, the lever effect may cause the tail to lift out of the water commonly referred to as "blowing the tail out of the water" or "a blowout". Even if the tail does not fully blow out, an overloaded tail can unexpectedly cavitate, lose grip and slide uncontrollably (i.e., upset the balance and control of the skier). Water ski designers have long sought ways to keep the tail of water skis from blowing out, usually by making the ski ride lower in the water. Making the ski ride lower in the water lowers performance by adding drag, which limits acceleration and how quickly the ski can turn.

It would be desirable to implement a water ski fin that increases acceleration and reduces cavitation at the tail of the water ski to keep the tail of the water ski from sliding too much or blowing out.

SUMMARY

The invention concerns a water ski fin comprising a planar body and a plurality of chevrons. The planar body may have a top end, a convex leading edge, and a trailing edge. The mounting elements on the top end may mount the fin on a tail of a water ski. A bottom may connect the leading edge to the trailing edge. A plurality of chevrons may have alternating crests and troughs positioned in the trailing edge.

BRIEF DESCRIPTION OF THE FIGURES

Embodiments of the invention will be apparent from the following detailed description and the appended claims and drawings.

DETAILED DESCRIPTION OF THE EMBODIMENTS

Embodiments of the present invention include providing a water ski fin that may (i) reduce drag, (ii) reduce the chance of a blow out around a turn, (iii) enable a water flow pattern that limits cavitation, (iv) resist sliding out while slalom skiing, (v) provide an inset compared to a conventional water ski to enable easier turning, (vi) provide turbulator strips to improve water flow, (vii) enable wing adjustment, (viii) provide a competitive advantage to a water skier, (ix) implement a crest (or crests) on a trailing edge of a ski fin with an upward angle that best aligns the shape of the crest or crests with the flow of water passing by the tail of the ski as it slides through the water at the most extreme angles presented by slalom turns, (x) reduce unwanted lift of a water ski tail and/or (xi) be implemented to fit in the mounting bracket of a conventional water ski.

Embodiments of the present invention may implement a water ski fin. The water ski fin may comprise a slide-resistant trailing edge. The slide resistant trailing edge may comprise a number of alternating crests and troughs. In one example, the alternating crests and troughs may implement a chevron design.

The slide-resistant trailing edge of the water ski fin may enable a water flow pattern that may reduce cavitation. The water flow pattern generated in response to the slide-resistant trailing edge moving through the water may provide increased resistance to sliding out of control or blowing out of the water altogether. The slide-resistant trailing edge may improve acceleration by creating substantially less drag than the holes used in conventional water ski fins. Improved tail grip and acceleration may provide tournament water skiers a competitive advantage. The slide-resistant trailing edge may provide an advantage (e.g., market value) to both skiers and ski designers alike. In an example, ski designers may use the slide-resistant trailing edge design of the water ski fin to build water skis that ride higher in the water, further improving turnability and acceleration.

The slide-resistant trailing edge may reduce cavitation. Reducing cavitation may maintain a depth of the ski tail in the water under duress (e.g., while the skier attempts to turn aggressively). In some embodiments, the crests of the slide-resistant trailing edge may be implemented with an upward angle. The upward angle may increases efficiency as roll angles and smear levels increase (e.g., improving tail support). The improved tail support may be provided by the water ski fin during the high-speed, tight turns that typically follow late, narrow, scrambling approaches (e.g., when a water skier desires tail support). In one example, the increased tail hold may enable the water ski to be substantially smaller than conventional water ski fin designs, which may further reduce tip-rise out of turns further improving acceleration.

Figure 1:
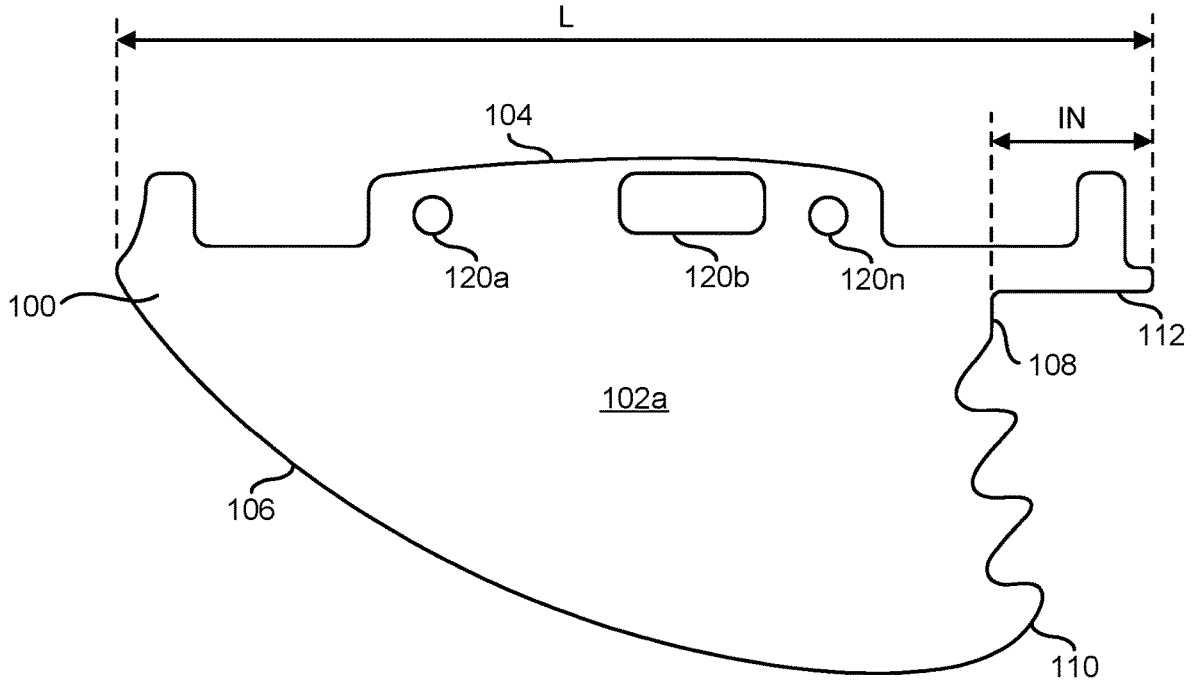
FIG. 1 is a diagram illustrating an example embodiment of the present invention.

Referring to FIG. 1, a diagram illustrating an example embodiment 100 of the present invention is shown. An example ski fin 100 is shown. A side view of the ski fin 100 is shown. The ski fin 100 may comprise a planar body 102*a*-102*b*. One face 102*a* of the planar body 102*a*-102*b* may be visible from the perspective shown (e.g., another face 102*b* may be on the opposite side of the face 102*a* shown).

The ski fin 100 may comprise a top end (or edge) 104, a leading edge 106, a trailing edge 108 and a bottom 110. The top edge 104 may be configured to mount to a water ski. The leading edge 106 may have a convex shape. The trailing edge 108 may implement the slide-resistant trailing edge. The bottom 110 may be configured to connect the leading edge 106 to the slide-resistant trailing edge 108.

In some embodiments, the slide-resistant trailing edge 108 may be inset from the length of the top edge 104. The top edge 104 is shown having a length (e.g., L). An inset 112 is shown. The inset 112 may be a distance (e.g., IN) from the end of the top edge 104. The slide-resistance trailing edge 108 may be inset the distance IN from the total length of the ski fin 100. For example, the leading edge 106, the slide-resistance trailing edge 108 and the bottom 110 may be implemented with a shorter length than the length L of the top edge 104 (e.g., shorter by the distance IN).

Openings 120*a*-120*n* are shown on the planar body 102*a*-102*b*. The openings 120*a*-120*n* may pass through the face 102*a* to the face 102*b* on the opposite side of the fin 100. The openings 120*a*-120*n* may implement mounting elements. The mounting elements 120*a*-120*n* may enable hardware to be installed to mount the ski fin 100 to a tail of a water ski. The mounting elements 120*a*-120*n* may be configured to mount to various types and/or formats of water ski. The size, number and/or orientation of the mounting elements 120*a*-120*n* may be varied according to the design criteria of a particular implementation.

The top edge 104 may implement an irregular shape. The irregular shape and/or the mounting elements 120*a*-120*n* may enable precise adjustment of the fin 100. The precise adjustment may enable compatibility with any type of tournament water ski fin block.

Figure 2:
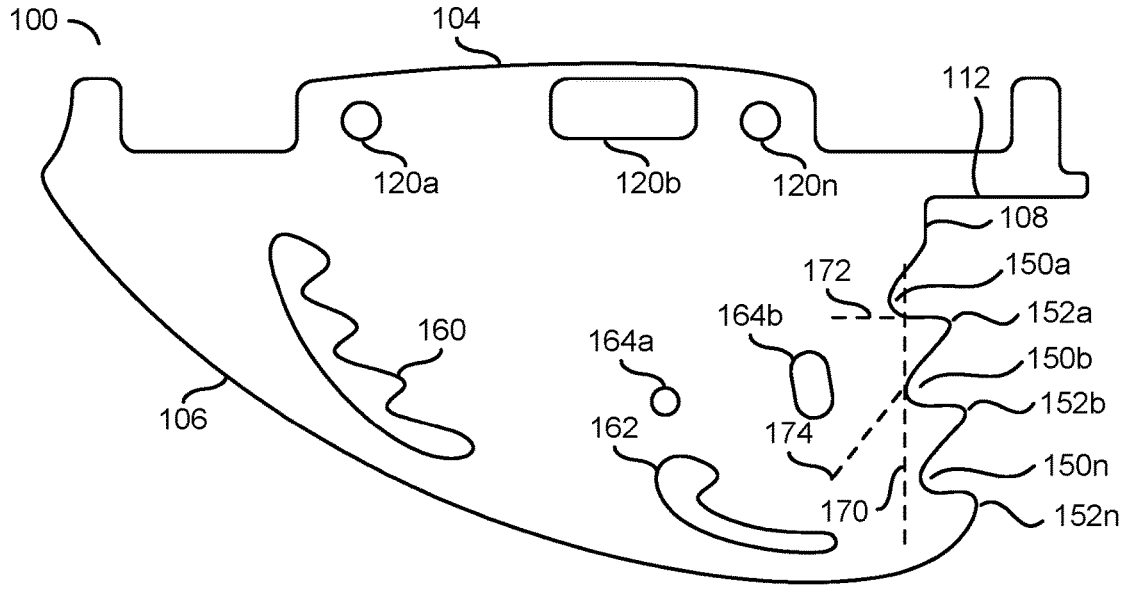
FIG. 2 is a diagram illustrating a side view of a water ski fin.

Referring to FIG. 2, a diagram illustrating a side view of a water ski fin is shown. The water ski 100 is shown comprising the top edge 104, the leading edge 106, the slide-resistant trailing edge 108, the bottom 110 and the inset 112. The mounting elements 120*a*-120*n* are shown.

The slide-resistant trailing edge 108 may comprise alternating troughs 150*a*-150*n* and crests 152*a*-152*n*. In one example, the alternating troughs 150*a*-150*n* and crests 152*a*-152*n* may form a wave-like pattern. In another example, the alternating troughs 150*a*-150*n* and crests 152*a*-152*n* may implement a chevron design. The alternating troughs 150*a*-150*n* and crests 152*a*-152*n* may be spaced along slide-resistant trailing edge 108 and then connect to the bottom 110. In the example shown, three of the troughs 150*a*-150*n* and three of the crests 152*a*-152*n* are shown. The number and/or size of each of the alternating troughs 150*a*-150*n* and crests 152*a*-152*n* may be varied according to the design criteria of a particular implementation.

Implementing the alternating troughs 150*a*-150*n* and crests 152*a*-152*n* of nearly any size or shape along the trailing edge 108 may generate a water flow pattern that may reduce and/or limit cavitation. Reducing and/or limiting the cavitation by using the alternating troughs 150*a*-150*n* and crests 152*a*-152*n* may enable the fin 100 to maintain control while the water skier is turning (e.g., provide increased resistance to sliding out of control and/or blowing out of the water). The alternating troughs 150*a*-150*n* and crests 152*a*-152*n* may enable the water skier to accelerate quickly by reducing and/or limiting an amount of drag.

A slot 160 and a slot 162 are shown on the water ski fin 100. The slots 160-162 may implement wavy slots that pass through the planar body 102*a*-102*b*. The two wavy slots 160-162 may implement turbulator strips. The turbulator strips 160-162 may be configured to enable water flow along a low-pressure side of the fin 100 from the front. Details of the turbulator strips 160-162 may be described in association with U.S. Pat. No. 10,723,417, filed on Dec. 4, 2018, appropriate portions of which are hereby incorporated by reference.

Holes 164*a*-164*b* are shown. The holes may pass through the planar body 102*a*-102*n*. The holes 164*a*-164*b* may be configured to enable mounting an adjustable wing to the water ski fin 100.

A dotted vertical line 170 is shown along the trailing edge 108. The dotted vertical line 170 may be a reference line (e.g., not representative of any physical component of the fin 100). The reference line 170 is shown generally even with the troughs 150*a*-150*n* of the trailing edge 108.

A dotted horizontal line 172 and a dotted angled line 174 are shown extending from the reference line 170. The dotted horizontal line 172 may represent an angle of a top portion of the crest 152*a*. For example, the dotted horizontal line 172 may represent an angle that the crest 152*a* extends from the trough 150*a*. The dotted angled line 174 may represent an angle of a bottom portion of the crest 174. For example, the dotted angled line 174 may represent an angle that the crest 152*a* extends into the adjacent trough 150*b*. The dotted horizontal line 172 and the dotted angled line 174 may illustrate that the alternating troughs 150*a*-150*n* and crests 152*a*-152*n* may have an upward angle. For example, a top portion and the bottom portion of each individual one of the crests 152*a*-152*n* may meet at less than a 90 degree angle.

In some embodiments, angling the alternating troughs 150*a*-150*n* and crests 152*a*-152*n* upward may provide increased effectiveness of the slide-resistant trailing edge 108 at high roll angles of the fin 100 and/or during extreme slides performed by the skier (e.g., compared to other designs of the alternating troughs 150*a*-150*n* and crests 152*a*-152*n*). For example, the increased effectiveness of angling the alternating troughs 150*a*-150*n* and crests 152*a*-152*n* upward may enable a competitive advantage such as a strong tail hold and/or quick acceleration. In another example, the increased effectiveness of angling the alternating troughs 150*a*-150*n* and crests 152*a*-152*n* upward may enable water ski designs to ride higher in the water (e.g., resulting in improved turnability and acceleration).

Figure 3:
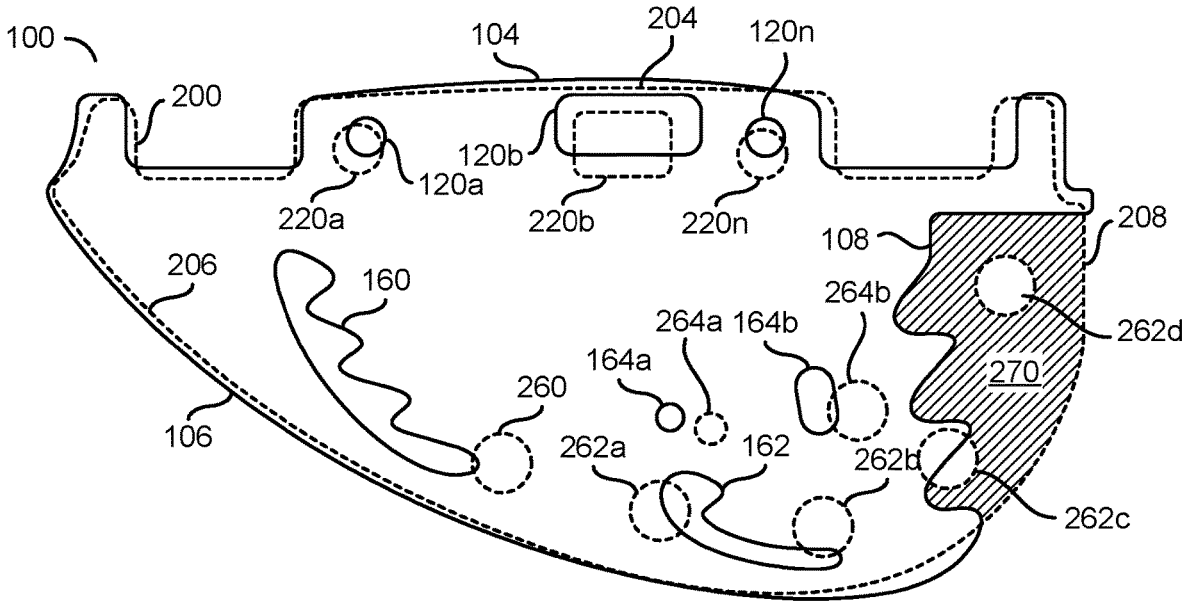
FIG. 3 is a diagram illustrating a side view of a water ski fin compared with a conventional fin.

Referring to FIG. 3, a diagram illustrating a side view of a water ski fin compared with a conventional fin is shown. A shape 200 is shown. The shape 200 may represent the shape of a conventional water ski fin. The conventional water ski fin shape 200 is shown overlaid on top of the water ski fin 100.

The top edge 104, the leading edge 106, the slide-resistant trailing edge 108, the mounting elements 120*a*-120*n*, the turbulator slots 160-162 and the openings 164*a*-164*b* of the fin 100 are shown. A top edge 204, a leading edge 206, a trailing edge 208, mounting elements 220*a*-220*n*, an opening 260 and openings 262*a*-262*d* and openings 264*a*-264*b* of the conventional water ski fin 200 are shown. The conventional water ski fin shape 200 may not have a bottom similar to the bottom 110 of the slide-resistant trailing edge 108 or the inset 112 since the conventional water ski fin shape 200 does not implement the alternating troughs 150*a*-150*n* and crests 152*a*-152*n*. Without the inset 112, the total surface area of the conventional water ski shape 200 may be larger than the area of the water ski fin 100 (e.g., the conventional water ski shape 200 may have a longer bottom portion than the water ski fin 100). An area 270 is shown. The area 270 may represent an amount of area that is not present on the water ski fin 100 because of the design of the slide-resistant trailing edge 108.

The holes 260 and/or 262*a*-262*d* in the conventional water ski fin 100 may be implemented to reduce cavitation. However, the effectiveness of the holes 260 and/or 262*a*-262*d* may be less effective than implementing the slide-resistant trailing edge 108. For example, implementing the holes 260 and/or 262*a*-262*d* result in the extra area 270. The extra area 270 of the conventional water ski fin 200 may make turning a tournament ski challenging for most skiers. The alternating troughs 150*a*-150*n* and crests 152*a*-152*n* may improve fin performance so much compared to the openings 260 and/or 262*a*-262*d* that the fin 100 may be implemented smaller and easier to turn while still delivering more tail-hold than the larger standard fin 200. The alternating troughs 150*a*-150*n* and crests 152*a*-152*n* may also create less drag than the holes 260 and/or 262*a*-262*d*. Skiers of all levels benefit from skis that accelerate more quickly and turn more easily.

Figure 4:
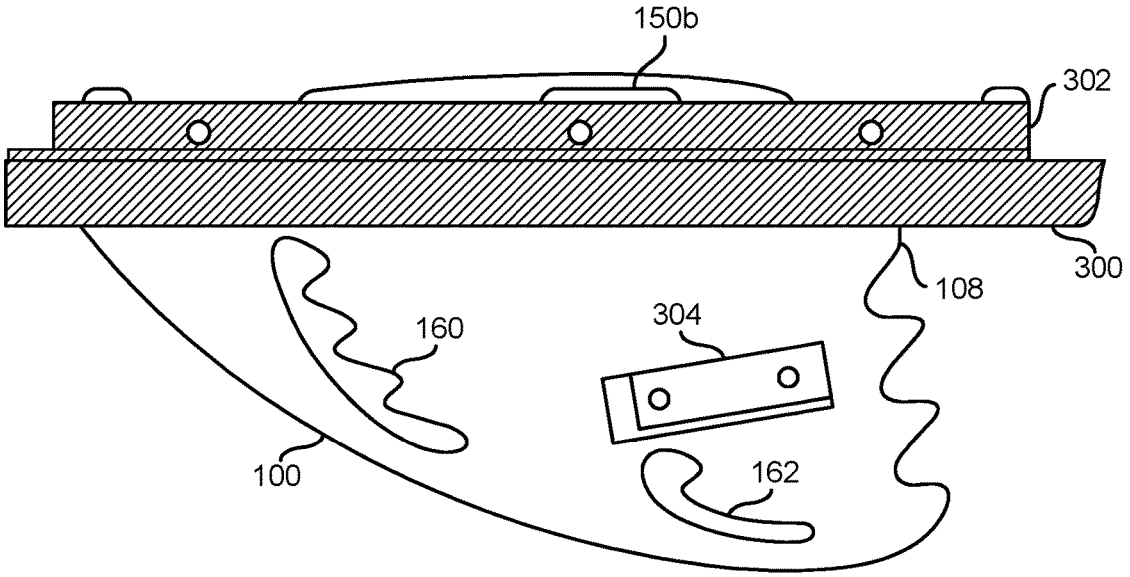
FIG. 4 is a diagram illustrating a side view of a water ski fin mounted to the tail of a water ski.

Referring to FIG. 4, a diagram illustrating a side view of a water ski fin mounted to the tail of a water ski is shown. A view of the water ski fin 100 is shown with the slide-resistant trailing edge 108. The mounting element 150*b* is partially shown. The turbulator slots 160-162 are shown on the water ski fin 100.

A water ski 300 and a fin block 302 are shown. The mounting elements 150*a*-150*b* may enable the fin 100 to mount to the water ski 300. A water ski wing 304 is shown. The openings 164*a*-164*b* may be covered by the water ski wing 304. The openings 164*a*-164*b* may provide mounting locations for the water ski wing 304 (e.g., if desired by the skier).

Figure 5:
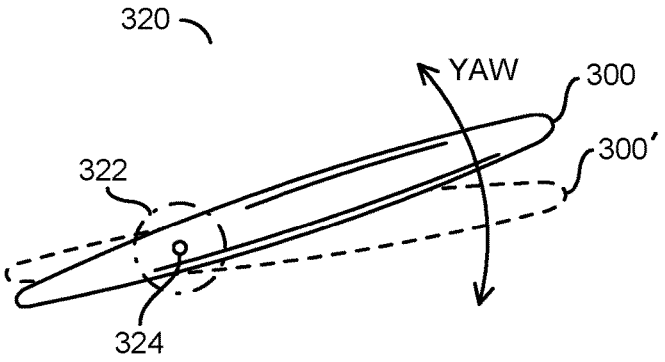
FIG. 5 is a diagram illustrating a water ski moving in a yawing direction.

Referring to FIG. 5, a diagram illustrating a water ski illustrating yaw is shown. A top down view 320 of the water ski 300 is shown. A dotted shape representing an alternate orientation of the water ski 300' is shown. A dotted circle 322 is shown. The dotted circle 322 may represent a rotation point of the water ski 300. For example, the water ski 300 may rotate at the rotation point 322 from the orientation shown to the alternate orientation of the water ski 300'.

A point 324 on the water ski 300 is shown. The point 324 may represent a general location of the feet of the skier. For example, the skier may attempt to rotate the water ski 300 to the alternate location 300' by adjusting a front end (e.g., a toe) of the water ski 300.

An arrow is shown representing a yaw rotation. The yaw rotation may result in the water ski 300 moving to the alternate orientation 300'. The yaw rotation may be performed about the rotation point 322. When the skier yaws more of the tip of the water ski 300 into the water, the radius of the turn is reduced, up until the tail of the water ski 300 starts to slide too much or blows out of the water.

Figure 6:
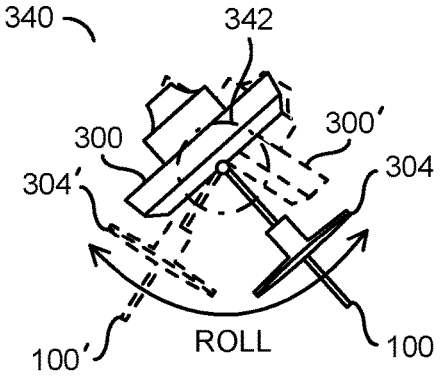
FIG. 6 is a diagram illustrating a water ski moving in a rolling direction.

Referring to FIG. 6, a diagram illustrating a water ski illustrating roll is shown. A rear view 340 of the fin 100 and the water ski 300 is shown. A dotted shape representing an alternate orientation of the fin 100' and the water ski 300' is shown. A dotted circle 342 is shown. The dotted circle 342 may represent a rotation point of the fin 100 and the water ski 300. For example, the fin 100 and the water ski 300 may rotate at the rotation point 342 from the orientation shown to the alternate orientation of the fin 100' and the water ski 300'.

The water ski wing 304 is shown on the fin 100 is shown. An alternate orientation of the water ski wing 304' is shown. The water ski wing 304 may rotate along with the water ski fin 100 and the water ski 300. For example, the skier may attempt to rotate the fin 100, the water ski 300 and the wing 304 to the alternate locations 100', 300' and 304' by tilting the water ski 300 (e.g., tilting one edge of the water ski 300 down towards the water).

An arrow is shown representing a roll rotation. The roll rotation may result in the fin 100 and the water ski 300 moving to the alternate orientation 100' and 300'. The roll rotation may be performed about the rotation point 342. The more the water ski 300 is rolled onto its edge, the less effective the fin 100 becomes, allowing the tail of the ski to slide more and tighten the radius of the turn, up until the tail slides too much or blows out of the water.

Figure 7:
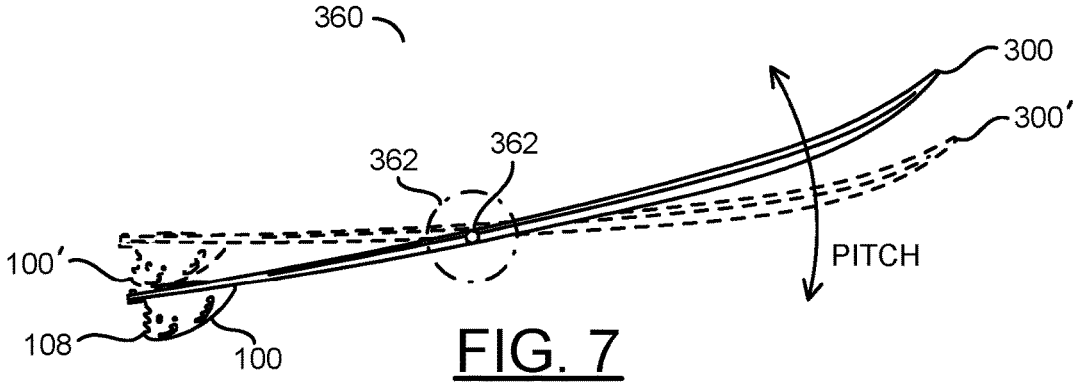
FIG. 7 is a diagram illustrating a water ski moving in a pitching direction.

Referring to FIG. 7, a diagram illustrating a water ski illustrating pitch is shown. A side view 380 of the fin 100 and the water ski 300 is shown. The slide-resistant trailing edge 108 is shown on the fin 100. A dotted shape representing an alternate orientation of the fin 100' and the water ski 300' are shown. A dotted circle 362 is shown. The dotted circle 362 may represent a rotation point of the fin 100 and the water ski 300. For example, the fin 100 and the water ski 300 may rotate at the rotation point 362 from the orientation shown to the alternate orientation of the fin 100' and the water ski 300'.

A point 364 on the water ski 300 is shown. The point 364 may represent a general location of the feet of the skier. For example, the skier may attempt to rotate the water ski 300 to the alternate location 300' by lifting and/or lowering a front end (e.g., a toe) of the water ski 300 into or out of the water. The more the tip of the water ski 300 is pitched into the water the more power the water ski 300 has to accelerate and the tighter the radius of turns will be, up until the tail slides too much or blows out of the water.

An arrow is shown representing a pitch rotation. The pitch rotation may result in the fin 100 and the water ski 300 moving to the alternate orientation 100' and 300'. The yaw rotation may be performed about the rotation point 362.

Figure 8:
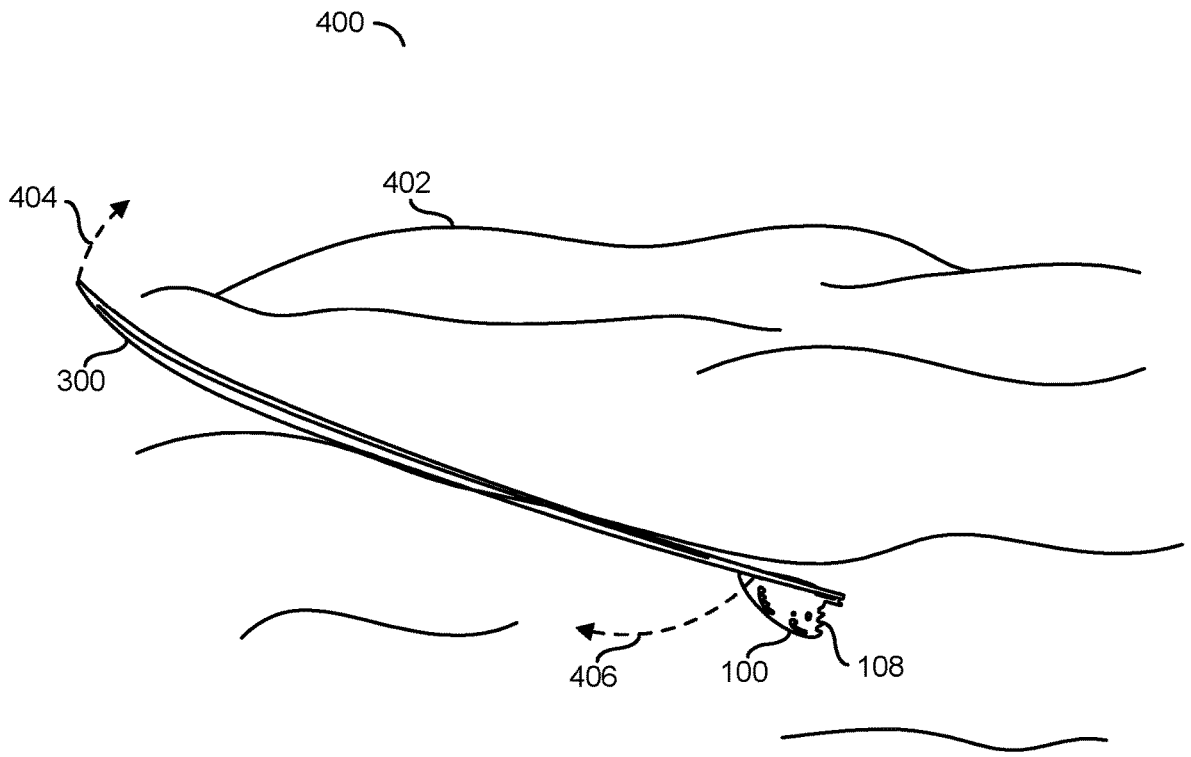
FIG. 8 is a diagram illustrating a water ski illustrating the direction of tail slide with the fin under water.

Referring to FIG. 8, a diagram illustrating a water ski illustrating the direction of tail slide with the fin under water is shown. A view 400 is shown. The view 400 may comprise the water ski 300 in water 402. For example, the view 400 may be a representative example of the water ski 300 while a skier is water skiing in the water 402. For illustrative purposes, only one water ski is shown and a skier is not shown on the water ski 300.

The ski fin 100 is shown mounted to the bottom and back end of the water ski 300. The slide-resistant trailing edge 108 is shown implemented by the fin 100. The fin 100 may be below the surface of the water 402.

A curved arrow 404 is shown at the tip of the water ski 300. The curved arrow 404 may represent a rotation (e.g., a yaw rotation) of the water ski 300. For example, a water skier may attempt to turn inwards (e.g., turn right) by rotating the water ski 300 in the direction 404.

A curved arrow 406 is shown at the tail of the water ski 300. The curved arrow 406 is shown extending from the fin 100. The curved arrow 406 may represent a rotation (e.g., a combination of yawing and pitching motions) of the water ski 300. The rotation 406 at the tail of the water ski 300 may compliment the rotation 404 at the toe of the water ski 300. For example, as more tip engages the water, the middle of the water ski 300 slides less than the tail, pointing the tip of the water ski 300 inwards towards a tighter turning radius. In an example, the rotation 406 may represent a direction of the tail slide with the fin 100 underwater.

On the face (e.g., the face 102*a* shown in association with FIG. 1) of the fin 100 shown, there may be a high amount of pressure on the fin 100 (e.g., a higher pressure on the top face). On the opposite face (e.g., the face 102*b*, not visible from the perspective shown) of the fin 100, there may be a low amount pressure on the fin 100 (e.g., a lower pressure on the bottom face). As the tail of the water ski 300 (with the fin 100) slides wide around turns, the pressure on the fin 100 is higher on the top side (e.g., shown) than on the bottom side (not visible). The pressure differential may result in turbulence and/or cavitation underneath the trailing edge 108 of the fin 100. The alternating troughs 150*a*-150*n* and crests 152*a*-152*n* and/or the upward angle of the alternating troughs 150*a*-150*n* and crests 152*a*-152*n* of the slide-resistant trailing edge 108 may be configured to prevent the reduction of effectiveness of the fin 100 caused by the turbulence and/or cavitation resulting from this pressure differential.

Figure 9:
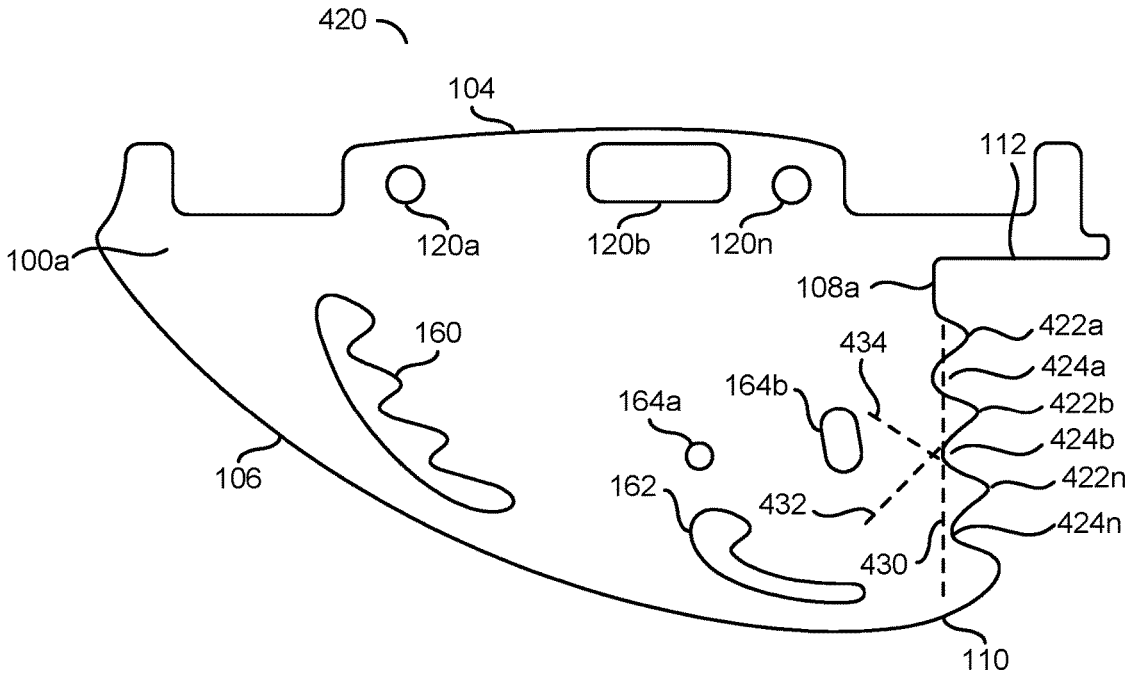
FIG. 9 is a diagram illustrating an alternate design of a slide-resistant trailing edge.

Referring to FIG. 9, a diagram illustrating an alternate design of a slide-resistant trailing edge is shown. An example embodiment 420 is shown. The example embodiment 420 may be the fin design 100*a*. The fin 100*a* is shown comprising the top edge 104, the leading edge 106, the bottom 110, the inset 112, the mounting elements 120*a*-120*n*, the turbulator slots 160-162 and the openings 164*a*-164*b* with a similar implementation as described in association with FIGS. 1-2.

The fin 100*a* may comprise the slide-resistant trailing edge 108*a*. The trailing edge 108*a* may comprise crests 422*a*-422*n* and troughs 424*a*-424*n*. The crests 422*a*-422*n* and troughs 424*a*-424*n* may be implemented to enable similar slide-resistant features as the alternating troughs 150*a*-150*n* and crests 152*a*-152*n* of the trailing edge 108 described in association with FIG. 2. The crests 422*a*-422*n* and the troughs 424*a*-424*n* may have a different design than the alternating troughs 150*a*-150*n* and crests 152*a*-152*n*, which may impact an effectiveness of the slide-resistant features.

A dotted vertical line 430 is shown. The dotted vertical line 430 may represent a reference line (e.g., not a physical element of the fin 100*a*). Dotted angled lines 432-434 are shown extending from the reference line 430. The dotted angled line 432 may represent an angle of a bottom portion of the crest 422*b*. For example, the dotted angled line 432 may represent an angle that the crest 422*b* into the adjacent trough 424*b*. The dotted angled line 434 may represent an angle of a top portion of the crest 422*n*. For example, the dotted angled line 434 may represent an angle that the crest 422*n* extends from the adjacent trough 424*b*. The dotted horizontal lines 432-434 may illustrate that the alternating crests 422*a*-422*n* and troughs 424*a*-424*n* may be implemented with a general V shape (e.g., no upward angle). The different shape of the alternating crests 422*a*-422*n* and troughs 424*a*-424*n* of the fin design 100*a* compared to the alternating troughs 150*a*-150*n* and crests 152*a*-152*n* shown in association with FIG. 2 may result in different advantages and/or disadvantages that may be desired for a particular skier (e.g., a trade-off between acceleration and cavitation, an ease of sliding out the ski to turn, etc.).

Figure 10:
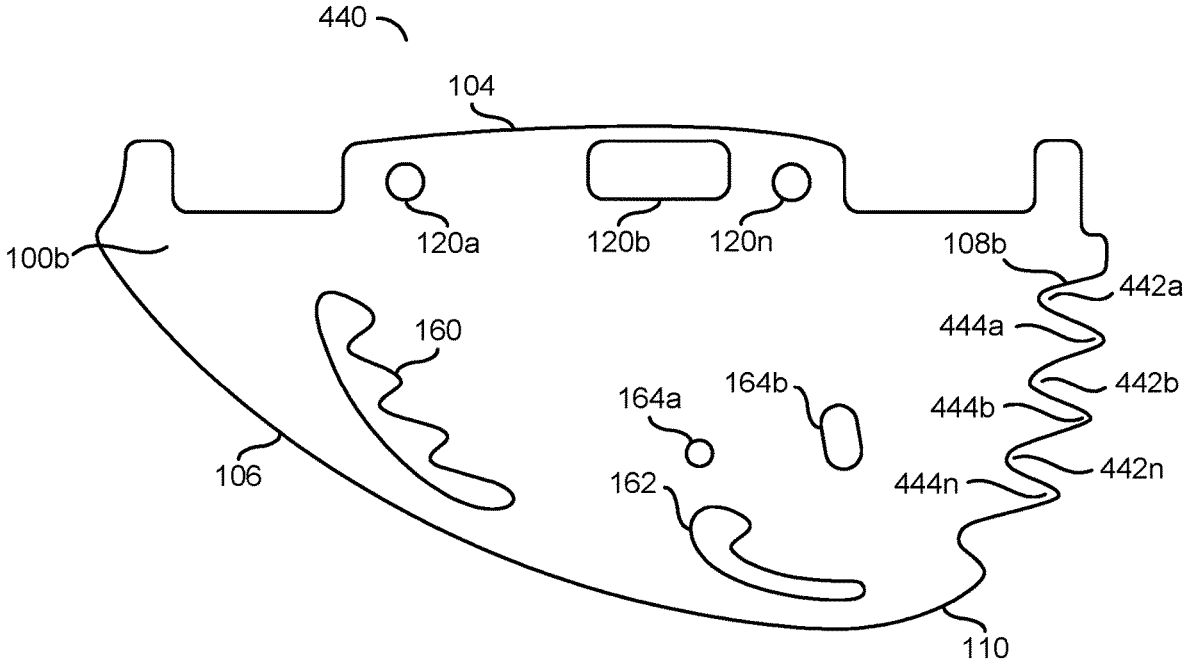
FIG. 10 is a diagram illustrating an alternate design of a slide-resistant trailing edge without an inset.

Referring to FIG. 10, a diagram illustrating an alternate design of a slide-resistant trailing edge without an inset is shown. An example embodiment 440 is shown. The example embodiment 440 may be the fin design 100*b*. The fin 100*b* is shown comprising the top edge 104, the leading edge 106, the bottom 110, the mounting elements 120*a*-120*n*, the turbulator slots 160-162 and the openings 164*a*-164*b* with a similar implementation as described in association with FIGS. 1-2.

The fin 100*b* may comprise the slide-resistant trailing edge 108*b*. The slide-resistant trailing edge 108*b* may not necessarily be implemented with the inset 112 shown in association with FIG. 1. For example, the leading edge 106 and the bottom 110 may be longer for the fin design 100*b* than for the fin 100 shown in association with FIG. 1. The trailing edge 108*b* may comprise alternating troughs 442*a*-442*n* and crests 444*a*-444*n*. The alternating troughs 442*a*-442*n* and crests 444*a*-444*n* may be implemented to enable similar slide-resistant features as the alternating troughs 150*a*-150*n* and crests 152*a*-152*n* of the trailing edge 108 described in association with FIG. 2. The alternating troughs 442*a*-442*n* and crests 444*a*-444*n* may have a different design than the alternating troughs 150*a*-150*n* and crests 152*a*-152*n*, which may impact an effectiveness of the slide-resistant features.

The alternating troughs 442*a*-442*n* and crests 444*a*-444*n* may have a longer shape than the alternating troughs 150*a*-150*n* and crests 152*a*-152*n*. For example, since the trailing edge 108*b* is not implemented with the inset 112, the alternating troughs 442*a*-442*n* and crests 444*a*-444*n* may extend (e.g., have a long point) to enable the trailing edge 108*b* to generally be even with the length of the top edge 104 (e.g., the length L). The different shape of the alternating troughs 442*a*-442*n* and crests 444*a*-444*n* of the fin design 100*b* compared to the alternating troughs 150*a*-150*n* and crests 152*a*-152*n* shown in association with FIG. 2 may result in different advantages and/or disadvantages that may be desired for a particular skier (e.g., a trade-off between acceleration and cavitation, an ease of sliding out the ski to turn, etc.).

Figure 11:
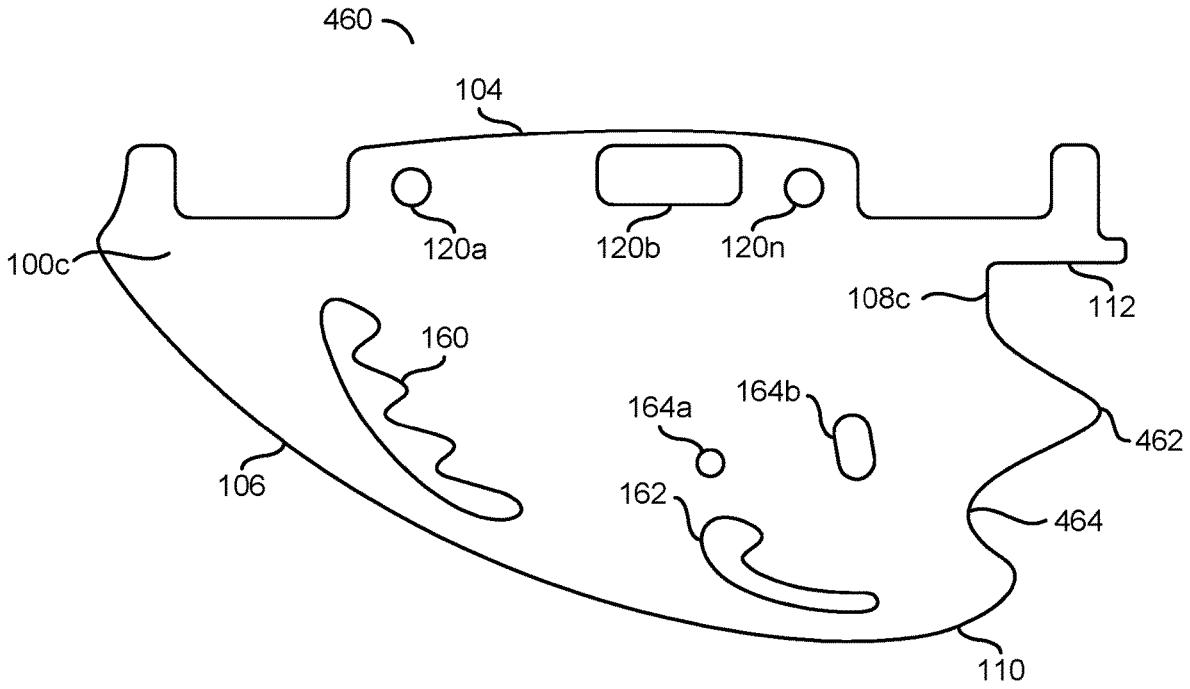
FIG. 11 is a diagram illustrating an alternate design of a slide-resistant trailing edge with a long crest.

Referring to FIG. 11, a diagram illustrating an alternate design of a slide-resistant trailing edge with a long crest is shown. An example embodiment 460 is shown. The example embodiment 460 may be the fin design 100*c*. The fin 100*c* is shown comprising the top edge 104, the leading edge 106, the bottom 110, the inset 112, the mounting elements 120*a*-120*n*, the turbulator slots 160-162 and the openings 164*a*-164*b* with a similar implementation as described in association with FIGS. 1-2.

The fin 100*c* may comprise the slide-resistant trailing edge 108*c*. The trailing edge 108*c* may comprise a single crest 462 and a single trough 464. The single crest 462 and the single trough 464 may be implemented to enable similar slide-resistant features as the alternating troughs 150*a*-150*n* and crests 152*a*-152*n* of the trailing edge 108 described in association with FIG. 2. The single crest 462 and the single trough 464 may have a different design than the alternating troughs 150*a*-150*n* and crests 152*a*-152*n*, which may impact an effectiveness of the slide-resistant features.

The single crest 462 may have a larger and longer shape than the crests 152*a*-152*n*. For example, the trailing edge

108*c* may implement the inset 112, and the single crest 462 may extend (e.g., have a long point) to enable the single crest 462 to generally be even with the length of the top edge 104. For example, the single crest 462 may have a length of approximately the length of the inset 112 (e.g., the length IN). The different shape of the single crest 462 and the single trough 464 of the fin design 100*c* compared to the alternating troughs 150*a*-150*n* and crests 152*a*-152*n* shown in association with FIG. 2 may result in different advantages and/or disadvantages that may be desired for a particular skier (e.g., a trade-off between acceleration and cavitation, an ease of sliding out the ski to turn, etc.).

Figure 12:
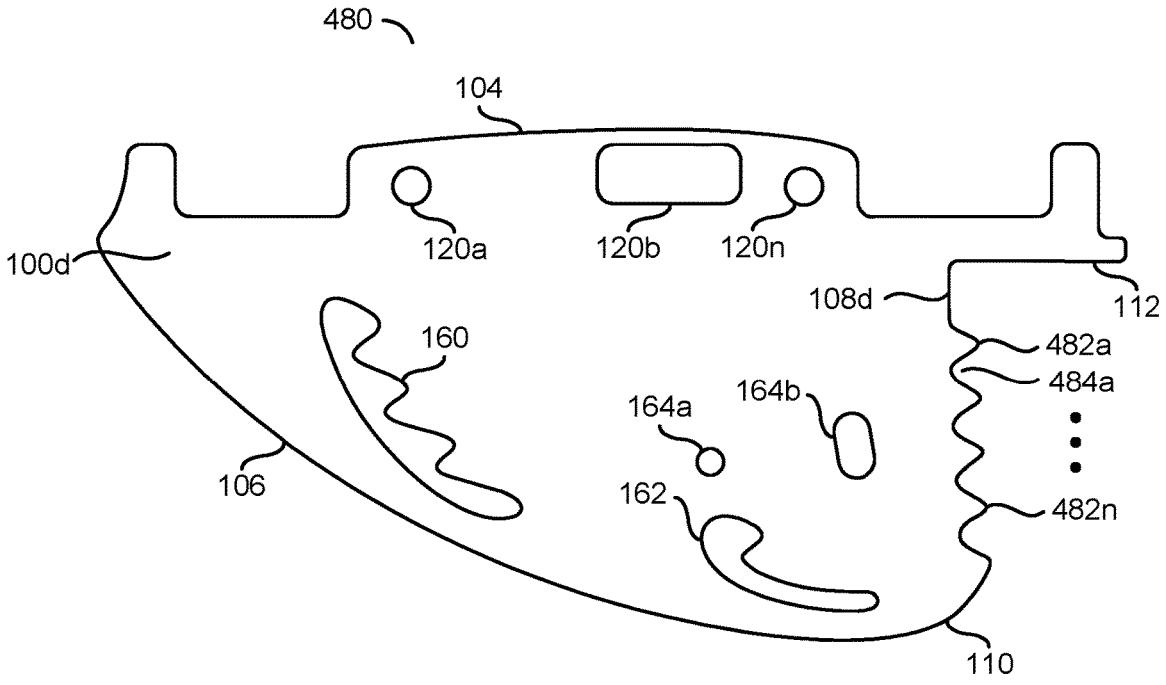
FIG. 12 is a diagram illustrating an alternate design of a slide-resistant trailing edge with a high frequency crest.

Referring to FIG. 12, a diagram illustrating an alternate design of a slide-resistant trailing edge with a high frequency crest is shown. An example embodiment 480 is shown. The example embodiment 480 may be the fin design 100*d*. The fin 100*d* is shown comprising the top edge 104, the leading edge 106, the bottom 110, the inset 112, the mounting elements 120*a*-120*n*, the turbulator slots 160-162 and the openings 164*a*-164*b* with a similar implementation as described in association with FIGS. 1-2.

The fin 100*d* may comprise the slide-resistant trailing edge 108*d*. The trailing edge 108*d* may comprise a compact (e.g., high frequency) alternating crests 482*a*-482*n* and troughs 484*a*-484*n*. The compact alternating crests 482*a*-482*n* and troughs 484*a*-484*n* may be implemented to enable similar slide-resistant features as the alternating troughs 150*a*-150*n* and crests 152*a*-152*n* of the trailing edge 108 described in association with FIG. 2. The compact alternating crests 482*a*-482*n* and troughs 484*a*-484*n* may have a different design than the alternating troughs 150*a*-150*n* and crests 152*a*-152*n*, which may impact an effectiveness of the slide-resistant features.

The compact alternating crests 482*a*-482*n* and troughs 484*a*-484*n* may have a smaller size than the alternating troughs 150*a*-150*n* and crests 152*a*-152*n*. The smaller size of the alternating crests 482*a*-482*n* and troughs 484*a*-484*n* may enable more of the alternating crests 482*a*-482*n* and troughs 484*a*-484*n* on the trailing edge 108*d* than the trailing edge 108 shown in association with FIG. 1. For example, a peak-to-peak distance between the compact crests 482*a*-482*n* may be shorter than the peak-to-peak distance between the crests 152*a*-152*n*. The length of the compact crests 482*a*-482*n* may be shorter than the crests 152*a*-152*n*. For example, the length of the crests 152*a*-152*n* may be closer to the length IN of the inset 112 than the length of the compact crests 482*a*-482*n*.

In one example, the compact alternating crests 482*a*-482*n* and troughs 484*a*-484*n* may be implemented with a similar upward angle design as the alternating troughs 150*a*-150*n* and crests 152*a*-152*n* of the trailing edge 108 as shown in association with FIG. 2. In another example, the compact alternating crests 482*a*-482*n* and troughs 484*a*-484*n* may have the V shape design similar to the alternating crests 422*a*-422*n* and troughs 424*a*-424*n* of the trailing edge 108*a* as shown in association with FIG. 9. The shape of the compact alternating crests 482*a*-482*n* and troughs 484*a*-484*n* may be varied according to the design criteria of a particular implementation. The different amount of alternating crests 482*a*-482*n* and troughs 484*a*-484*n* of the fin design 100*d* compared to the alternating troughs 150*a*-150*n* and crests 152*a*-152*n* shown in association with FIG. 2 may result in different advantages and/or disadvantages that may be desired for a particular skier (e.g., a trade-off between acceleration and cavitation, an ease of sliding out the ski to turn, etc.).

Various sizes, shapes and angles of the trailing edge 108 may be implemented. The number of chevrons may be varied. FIGS. 9-12 show a number of example implementations. Other implementations of the chevrons may be implemented. The types of chevrons implemented by the trailing edge 108 may be varied according to the design criteria of a particular implementation.

The terms "may" and "generally" when used herein in conjunction with "is(are)" and verbs are meant to communicate the intention that the description is exemplary and believed to be broad enough to encompass both the specific examples presented in the disclosure as well as alternative examples that could be derived based on the disclosure. The terms "may" and "generally" as used herein should not be construed to necessarily imply the desirability or possibility of omitting a corresponding element.

While the invention has been particularly shown and described with reference to embodiments thereof, it will be understood by those skilled in the art that various changes in form and details may be made without departing from the scope of the invention.

The invention claimed is:

1. A water ski fin comprising:
- a body having opposing flat surfaces;
- a top end with mounting elements for mounting the water ski fin on a fin block on a tail of a water ski;
- a leading edge comprising a continuously smooth convex shape;
- a trailing edge forming a plurality of chevrons; and
- a bottom connecting the leading edge to the trailing edge, wherein
  - (i) said plurality of chevrons each comprising an alternating crest and trough positioned along said trailing edge, and
  - (ii) said mounting elements are implemented through projections of said top end that fit into said fin block.

2. The water ski fin according to claim 1, wherein said chevrons reduce cavitation of water near the tail of the water ski.

3. The water ski fin according to claim 2, wherein the reduced cavitation keeps the tail of the water ski from sliding out during a turn.

4. The water ski fin according to claim 1, wherein the plurality of chevrons increase acceleration and reduce drag of the water ski during a turn.

5. The water ski fin according to claim 1, wherein each of the plurality of chevrons has an upwardly angled shape.

6. The water ski fin according to claim 1, wherein said trailing edge is inset from said top end.

7. The water ski fin according to claim 6, wherein said inset of said trailing edge enables a shorter length of said leading edge and said bottom.

8. The water ski fin according to claim 6, wherein said inset of said trailing edge reduces a size of said fin.

9. The water ski fin according to claim 1, wherein said alternating crest and trough comprise a V shape.

10. The water ski fin according to claim 1, wherein said fin further comprises at least one turbulator strip to provide an opening through said opposing flat surfaces of said body.

11. The water ski fin according to claim 10, wherein said turbulator strip enables water flow along a low-pressure side of said fin from a front side of said fin.

12. The water ski fin according to claim 1, wherein said alternating crest and trough of said plurality of chevrons enable said trailing edge to be slide-resistant.

13. The water ski fin according to claim 1, wherein said trailing edge comprises three of said alternating crests and troughs.

14. The water ski fin according to claim 1, wherein said trailing edge comprises more than three of said alternating crests and troughs.

15. An apparatus comprising:

a top end comprising one or more mounting elements;

a trailing edge comprising a plurality of alternating crests and troughs;

a leading edge comprising a continuously smooth convex shape; and a bottom end connecting said leading edge to said trailing edge, wherein (i) said apparatus is a body with opposing flat surfaces of a fin for a water ski, (ii) said mounting elements connect said body to a fin block of said water ski, and (iii) said mounting elements are implemented through a projections of said top end that fit into said fin block.

16. The apparatus according to claim 15, wherein said crests and troughs reduce cavitation of water near a tail of the water ski.

17. The apparatus according to claim 16, wherein the reduced cavitation keeps the tail of the water ski from sliding out during a turn.

18. The apparatus according to claim 15, wherein the crests and troughs increase acceleration and reduce drag of the water ski during a turn.

19. The apparatus according to claim 15, wherein each of the plurality of crests has an upwardly angled shape.

* * * * *